US006021813A

United States Patent [19]

Imhof et al.

[11] Patent Number: 6,021,813

[45] Date of Patent: Feb. 8, 2000

[54] ELECTROMAGNETICALLY ACTUATED DIRECTIONAL VALVE

[75] Inventors: Rainer Imhof, Frammersbach; Manfred Siegler, Lohr/Main, both of Germany

[73] Assignee: Mannesmann Rexroth AG, Lohr/Main, Germany

[21] Appl. No.: 09/043,807

[22] PCT Filed: Sep. 5, 1996

[86] PCT No.: PCT/EP96/03899

§ 371 Date: Mar. 25, 1998

§ 102(e) Date: Mar. 25, 1998

[87] PCT Pub. No.: WO97/12150

PCT Pub. Date: Apr. 3, 1997

[30] Foreign Application Priority Data

Sep. 26, 1995 [DE] Germany ..... 195 35 672
Dec. 2, 1995 [DE] Germany ..... 195 45 021

[51] Int. Cl.[7] ..... F15B 13/044

[52] U.S. Cl. ..... 137/625.65; 251/129.1

[58] Field of Search ..... 137/625.65; 251/129.1

[56] References Cited

U.S. PATENT DOCUMENTS

| | | | |
|---|---|---|---|
| 4,406,307 | 9/1983 | Loup et al. | 137/625.65 |
| 4,821,773 | 4/1989 | Herion et al. | 137/625.65 |
| 5,605,178 | 2/1997 | Jennins | 137/625.65 |
| 5,785,087 | 7/1998 | Takahashi et al. | 137/625.65 |

FOREIGN PATENT DOCUMENTS

| | | | |
|---|---|---|---|
| 0149743 | 7/1985 | European Pat. Off. . | |
| 0286683 | 10/1988 | European Pat. Off. . | |
| 2725917 | 9/1978 | Germany | 137/625.65 |
| 8704186 | 5/1987 | Germany . | |
| 3700899 | 7/1988 | Germany . | |
| 3844412 | 7/1990 | Germany . | |
| 4322513 | 1/1994 | Germany . | |
| 4237946 | 4/1994 | Germany . | |
| 4342563 | 6/1995 | Germany . | |
| 4417587 | 11/1995 | Germany . | |
| 63-208910 | 8/1988 | Japan | 137/625.65 |

OTHER PUBLICATIONS

Mannesman Rexroth: "4/2–Und 4/3–Proportional– . . . " Apr. 1993 Typenblatt RD 29060, pp. 1–12 XP000610475.

*Primary Examiner*—Gerald A. Michalsky
*Attorney, Agent, or Firm*—Martin A. Farber

[57] ABSTRACT

An electromagnetically actuated directional valve wherein the armature chambers are in communication with the source of working fluid via an inlet throttle and with the tank connection via an outlet throttle.

6 Claims, 3 Drawing Sheets

ELECTROMAGNETICALLY ACTUATED DIRECTIONAL VALVE

FIELD AND BACKGROUND OF THE INVENTION

The present invention relates to an electromagnetically actuatable directional valve.

Such valves are known from RD 29 060 of April 1993 of Mannesmann Rexroth. In order to obtain good automatic control of these valves, their valve chambers including the armature chambers of the actuating magnets which are in communication with each other via a channel extending within the valve housing must be vented. For this purpose, air-removal channels which can be closed by screws are present on the outer closure covers of the magnet housing. Upon the placing in operation, the closure screws are removed and working fluid introduced through the air-vent channel of the one actuating magnet until fluid emerges from the air-vent channel of the opposite actuating magnet. The air-vent channels are then closed by means of the closure screws.

SUMMARY OF THE INVENTION

The object of the invention is to create an electromagnetically actuated directional valve in connection with which the known cumbersome removal of air from the armature chambers of the actuating magnets can be dispensed with.

In accordance with the invention, the armature chambers are in communication via an inlet throttle (16, 17) with the connection (P) of the source of working fluid and, via an outlet throttle (7, 27, 8, 28), with the tank connection (T).

Due to the fact that the armature chambers are in communication with the source of working fluid via an inlet throttle and with the tank connection via an outlet throttle, the working fluid entering into the armature chambers is under a pressure the value of which is between the pump pressure and the tank pressure. The air present in the armature chambers is compressed by this pressure so that the armature chambers are substantially filled by the incoming working fluid so that dependable control of the valve is assured.

With the above and other objects and advantages in view, the present invention will become more clearly understood in connection with the detailed description of the preferred embodiment, when considered with the accompanying drawings of which:

DETAILED DESCRIPTION OF THE PREFERRED EMBODIMENT

Figure 1:
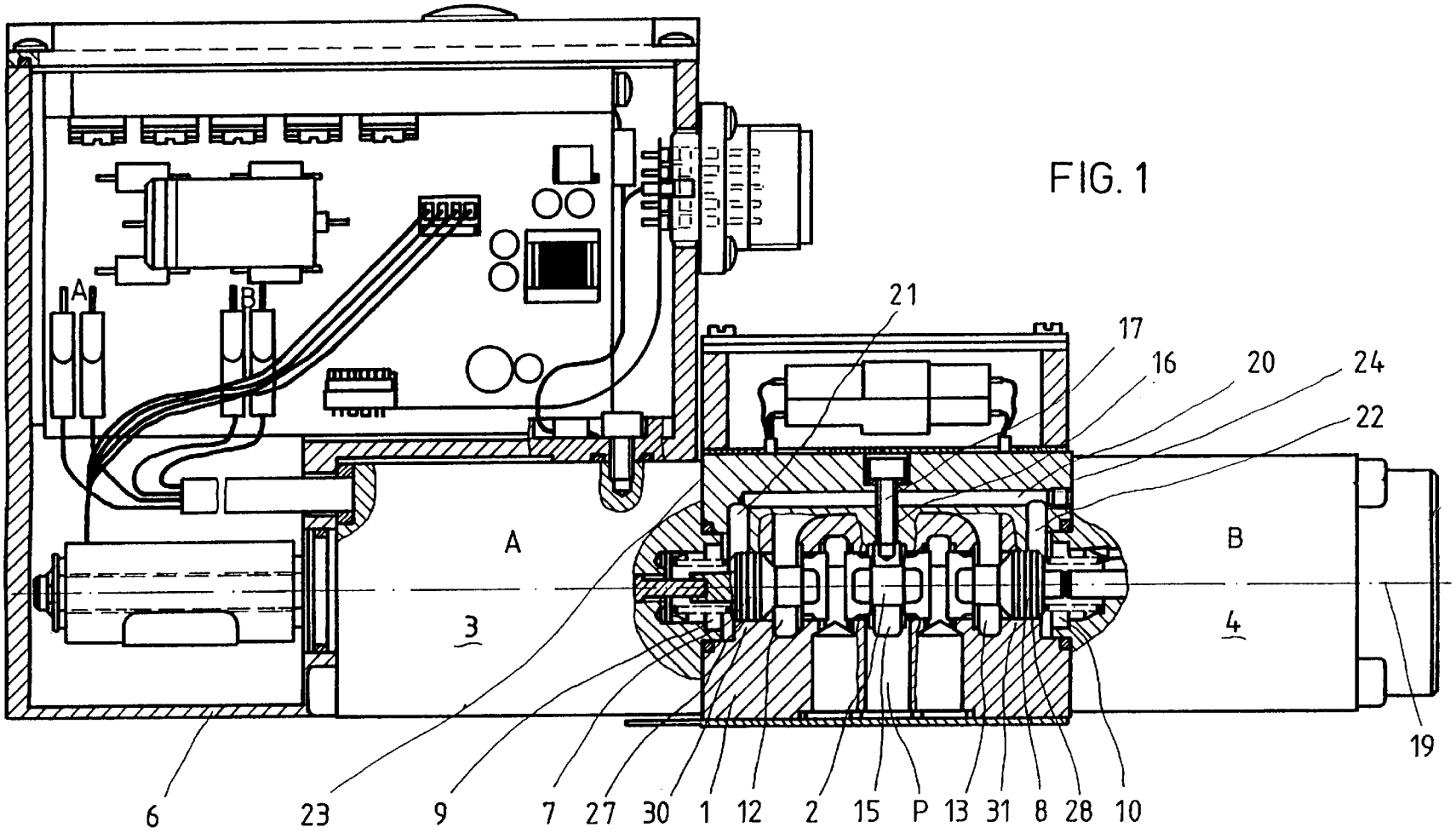
FIG. 1 is an axial section through a four-way proportional valve having two actuating magnets and integrated control electronics.

In FIG. 1, the valve housing is designated 1 and the control piston 2. The control piston 2 is displaced by the actuating magnets 3 and 4 fastened on both sides of the valve housing in one or the other direction, depending upon the signal given by the control electronics 6 placed on the actuating magnets 3. The control piston 2 has, on its ends, piston sections 7 and 8 which separate the housing recesses 9, 10 in communication with the armature chambers (not shown) of the actuating magnets from the control chambers 12, 13 of the valve housing 1 which are in communication with the tank from each other. From the control chamber 15 of the valve housing which is in communication with the working-fluid connection P, a housing-channel section provided with a female thread 16 and closed by a screw 17 leads to a housing-channel section 20 extending parallel to the actuating axis 19 of the control piston, from the ends of which housing channel sections 21, 22 extending from the ends of the housing channel section 20 close to the fastening walls 23, 24 for the actuating magnets 3 and 4 lead to the housing recesses 9, 10.

Figure 2:
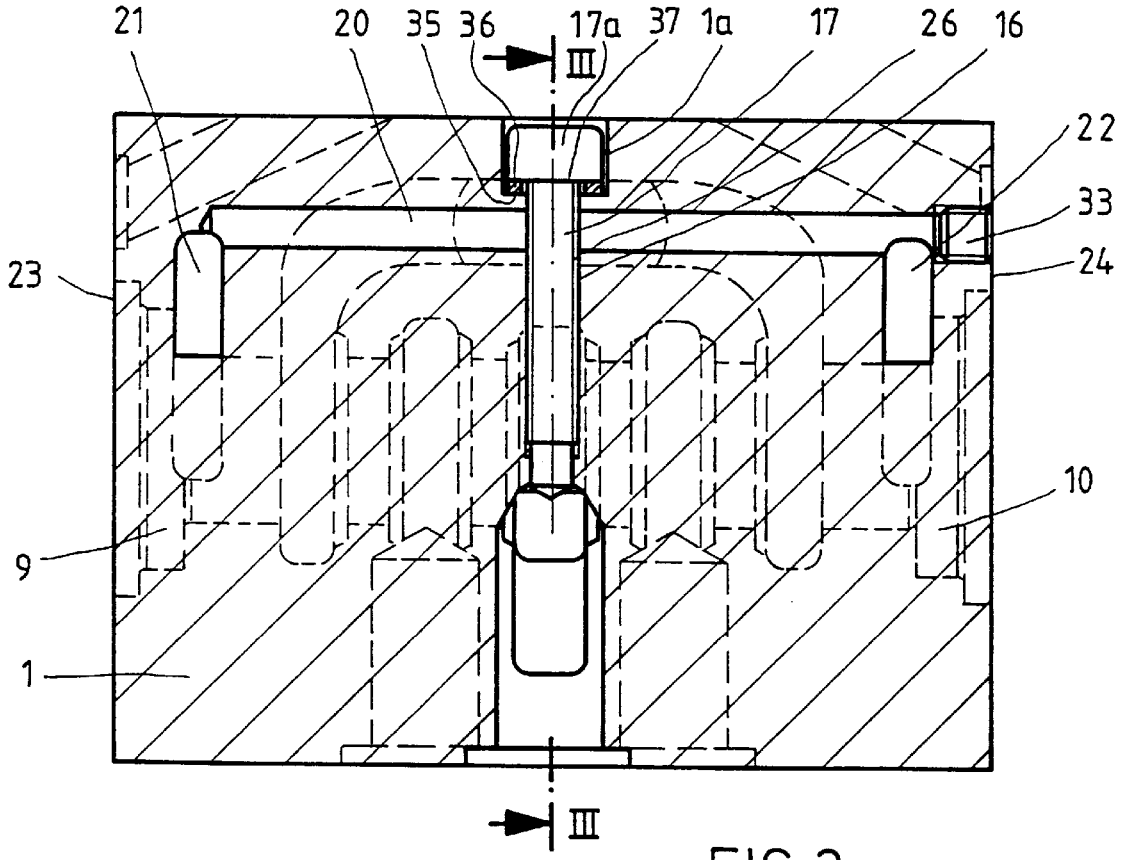
FIG. 2 is a longitudinal section through the valve housing in the plane of the housing channel with the threaded section with screw forming the throttle.

If, upon the placing in operation of a hydraulic system, the control chamber 15 which is in communication with the source of working fluid via the pressurized-fluid connection P is acted on by the working or pressurized fluid, then a small amount of working fluid flows via the flank clearance 26 (FIG. 2) between female and male threads of the housing channel section 16 closed by the screw 17 into the axially extending housing channel section 20 and from there further, via the lateral channel sections 21, 22, into the housing recesses 9, 10 and the armature chambers (not shown) of the actuating magnets 3, 4, not in liquid communication with said housing recesses 9, 10. From the housing recesses 9, 10 finally, the small amount of working fluid branched off from the main stream flows over the guidance clearance between the control-piston end sections 7, 8 and the guide holes 27, 28 in the housing flanges 30, 31 into the control chambers 12, 13 of the valve housing 1 which are in communication with the tank. The flank clearance between male and female threads of the channel section 16 and the screw 17 which forms the inlet throttle and the guidance clearance forming the outlet throttles in the end control piston sections 7, 8 in the guidance holes 27, 28 of the housing flanges 30, 31 for the housing recesses connected with the armature chambers are so adapted to each other that there is established within the armature chambers a pressure of the working fluid which compresses the air inclusions present in said chambers to such an extent that the incoming working fluid fills the armature chambers to such an extent that a dependable control of the valve is assured. By the control movement of the control piston, the working fluid present in the armature chamber is subjected to a backward and forward movement and in that way mixed with the small amount of working fluid flowing through the housing recesses so that, in the final analysis, also the air inclusions still present are washed into the tank. The inlet and outlet throttles are so adapted to each other that the working fluid present in the armature chambers is under a pressure which corresponds to 0.6 times the pump pressure. The sum of the cross sections of the two outlet throttles formed by the guidance clearance of the end control piston sections must therefore be kept slightly less than the cross section of the joint inlet throttle formed by the flank clearance between male and female threads in the channel section 16.

Figure 3:
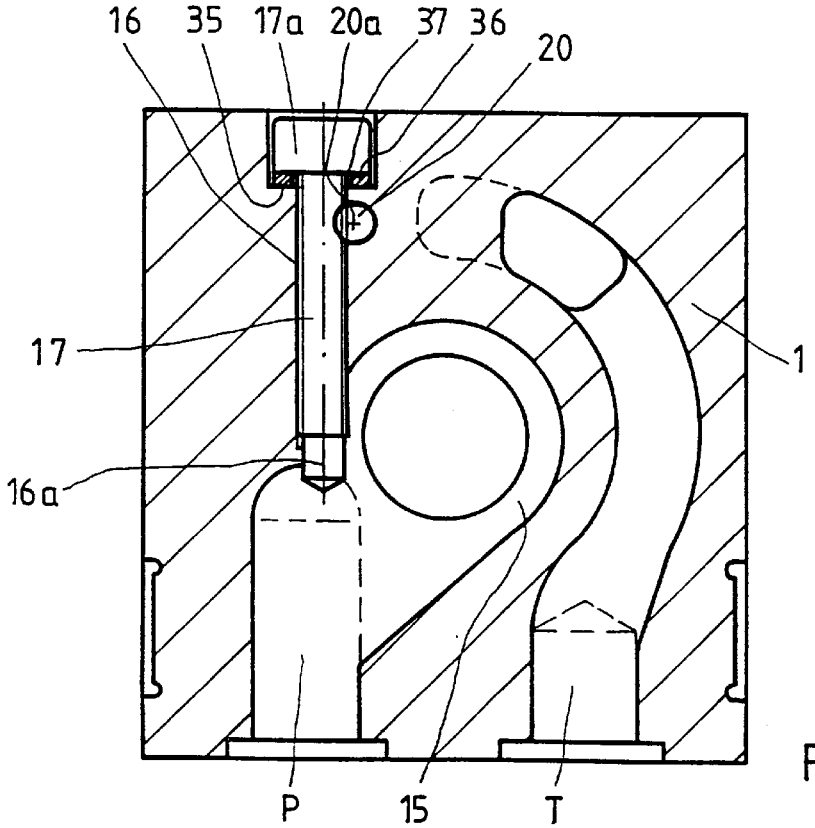
FIG. 3 is a section along the line III—III of FIG. 2.

In accordance with FIG. 3, the axially extending channel section of the threaded channel section 16 is cut into only in a small edge region 20*a*. As a result, the working fluid which enters into this region of the edge can distribute itself uniformly to both sides of the axially extending channel section 20 and flow further into the corresponding housing recesses 9, 10 which are in liquid communication with the armature chambers. The axially extending channel section 20 is introduced, in accordance with FIG. 2, as a blind hole into the valve housing 1 and closed off from the outside by means of a screw 33. The threaded channel section 16 which forms the feed throttle together with the screw 17 is worked from the outside into the valve housing and widened in the housing inlet region in order to receive the screw head 17*a*. On the radial surface 35 which results therefrom, a packing ring 36 is provided which, via the corresponding radially extending surface 37 of the screw head 17*a,* assures a liquid-tight seal of the threaded channel section from the outside.

Figure 4:
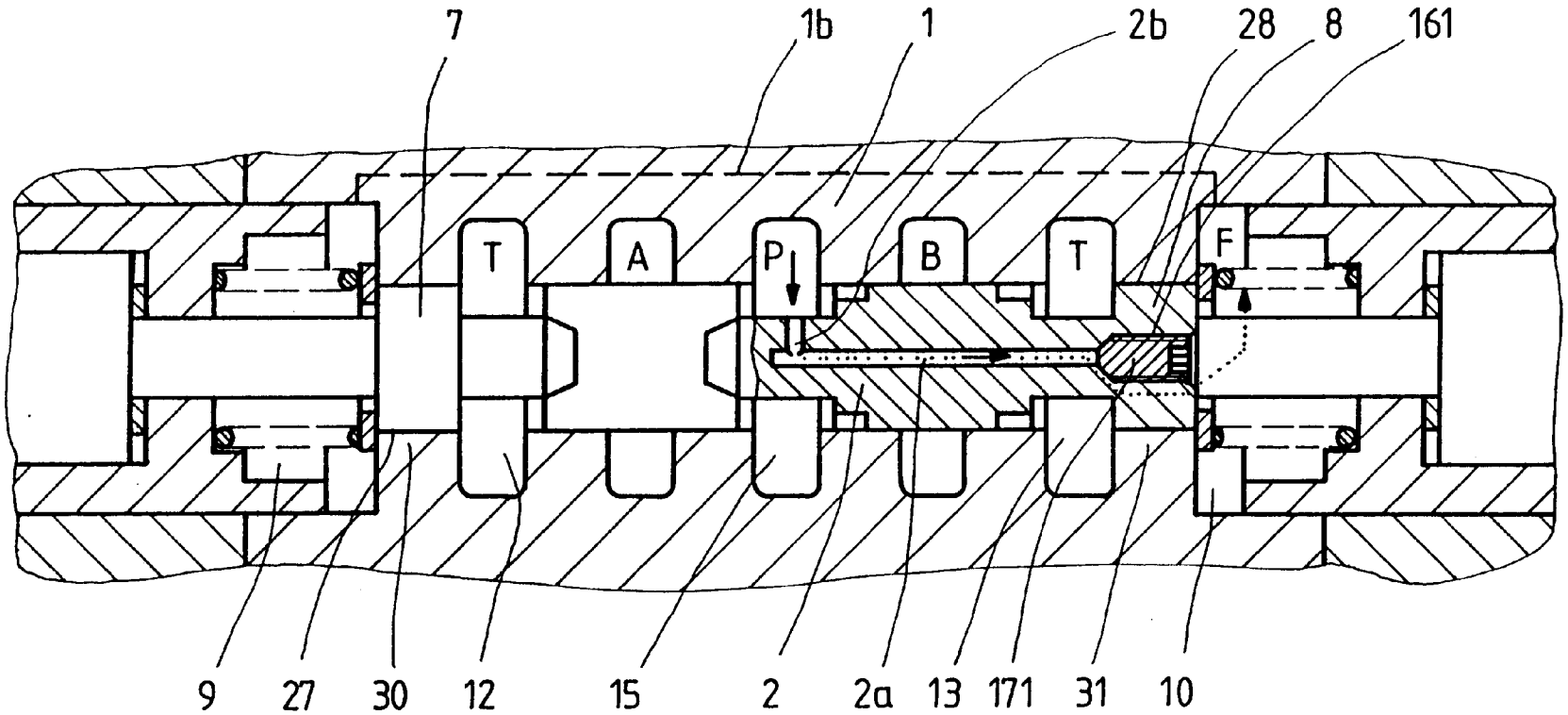
FIG. 4 is a partial longitudinal section through the proportional valve with throttle integrated in the control piston.

In accordance with FIG. 4, the control piston 2 has an axially extending blind hole 2*a* which is connected with a transverse hole 2*b* which discharges into the control chamber 15 connected with the working fluid connection P. On the control-piston end section 8, the blind hole is widened and provided with a grub screw 171. The flank clearance between female thread 161 and the thread of the grub screw 171 forms an inlet throttle over which, upon the placing in operation of the hydraulic system, a small amount of working fluid flows into the housing recess 10 and from there via a connecting channel 1*b* extending, as shown in dot-dash line, within the valve housing 1 also into the opposite housing recess 9. From the housing recesses 9, 10, the small amount of working fluid finally flows further, as in the embodiment of FIG. 1, over the guide clearance acting as outlet throttle between the control-piston end sections 7, 8 and the guidance holes 27, 28 in the housing flanges 30, 31 into the control chambers 12, 13 in communication with the tank, in which connection within the housing recesses 9, 10 and the armature chambers connected with the housing recesses, a pressure is built up which is determined by the size of the inlet throttle and the outlet throttles.

In order to obtain a constant pressure in the armature chambers, a pressure-limiting valve can be provided, independently of the guidance clearance of the control-piston end sections, between the one housing recess and the control chamber which is in communication with the tank.

We claim:

1. An electromagnetically actuated directional valve, particularly a proportional four-way valve, a magnet-side section of which separates control chambers connected with a tank from a corresponding armature chamber of an actuating magnet and the armature chambers which are in communication with each other are filled with working fluid, wherein:

the armature chambers are in communication via an inlet throttle (16, 17) with connection (P) of a source of the working fluid and, via an outlet throttle (7, 27, 8, 28), with a tank connection (T); and the inlet throttle (16, 17) is formed by the cross section of a flank clearance of a screw (17) which closes a section (16) of a housing channel (16, 20, 21, 22) having a female thread, which channel connects a control chamber (15) of a valve housing (1) connected with the source of working fluid with lateral housing recesses (9, 10) which are in fluid communication with the armature chamber of the corresponding actuating magnet (3, 4).

2. An electromagnetically actuated directional valve according to claim 1, wherein the housing channel (16, 20, 21, 22) comprises channel sections which are connected to each other, of which a first channel section (16) has the female thread closed by said screw (17) and forms the inlet throttle and extends perpendicular to an actuating axis (19) of a control piston (2) and discharges into the control chamber (15) of the valve housing (1), the control chamber (15) connecting with the source of working fluid, a second channel section (20) is connected with the first channel section, said second channel section (20) extends parallel to the actuating axis (19) of the control piston (2), and in each case third channel sections (21, 22) which extend close to attachment walls (23, 24) for the corresponding actuating magnets (3, 4) in the valve housing connect the second channel section (20) with the housing recesses (9, 10), said recesses (9, 10) being in connection with the armature chamber of the corresponding actuating magnet.

3. An electromagnetically actuated directional valve according to claim 2, wherein the axis (16*a*) of the channel section (16) forming a throttle place extends in a different plan than axis (20*a*) of the adjoining channel section (20), so that the channel section (16) only cuts the channel section (20).

4. An electromagnetically actuated directional valve according to claim 1, wherein the thread on the screw (17) and the female thread (16) are formed as standard threads.

5. An electromagnetically actuated directional valve, particularly a proportional four-way valve, a magnet-side section of which separates control chambers connected with a tank from a corresponding armature chamber of an actuating magnet and the armature chambers which are in communication with each other are filled with working fluid, wherein:

the armature chambers are in communication via an inlet throttle (16, 17) with connection (P) of a source of the working fluid and, via an outlet throttle (7, 27, 8, 28), with a tank connection (T); and the inlet throttle (16, 17) is formed by the cross section of a flank clearance of a screw (17) which closes a section (16) of a housing channel (16, 20, 21, 22) having a female thread, which channel connects a control chamber (15) of a valve housing (1) connected with the source of working fluid with lateral housing recesses (9, 10) which are in fluid communication with the armature chamber of the corresponding actuating magnet (3, 4).

6. An electromagnetically actuated directional valve according to claim 5, wherein a thread on the screw (171) and the female thread (161) are formed as standard threads.

* * * * *